United States Patent [19]

Boser et al.

[11] Patent Number: 4,593,635

[45] Date of Patent: Jun. 10, 1986

[54] METHOD AND APPARATUS FOR SEWING A SLIDE FASTENER TO FABRIC PIECES

[75] Inventors: Ronald J. Boser, Dix Hills, N.Y.; Shigeru Tanaka, Lyndhurst, N.J.

[73] Assignee: Yoshida Kogyo K. K., Tokyo, Japan

[21] Appl. No.: 708,727

[22] Filed: Mar. 6, 1985

[51] Int. Cl.[4] ..... D05B 3/12; D05B 21/00; D05B 33/02

[52] U.S. Cl. ..... 112/265.2; 112/104; 112/114; 112/152; 112/305

[58] Field of Search ..... 112/265.2, 265.1, 104, 112/113, 114, 121.26, 121.27, 121.29, 305, 152, 153

[56] References Cited

U.S. PATENT DOCUMENTS 3,381,639 5/1968 Miller ..... 112/121.27
3,710,745 1/1973 Yoshikawa ..... 112/265.2
3,848,556 11/1974 Terada et al. ..... 112/265.2
4,274,347 6/1981 Rohrer ..... 112/104
4,497,270 2/1985 Boser ..... 112/265.2

*Primary Examiner*—H. Hampton Hunter
*Attorney, Agent, or Firm*—Hill, Van Santen, Steadman & Simpson

[57] ABSTRACT

An improved method and apparatus for assembling fastening elements to fabric pieces including sewing separated fastener stringer tapes to respective fabric pieces pulling the sewn element downstream as the sewing proceeds, and partially combining the separated stringer tapes by pulling the slider downstream through a portion of the length of the fastener elements while retarding movement of the stringer tapes at their upstream ends.

12 Claims, 40 Drawing Figures

FIG. 7
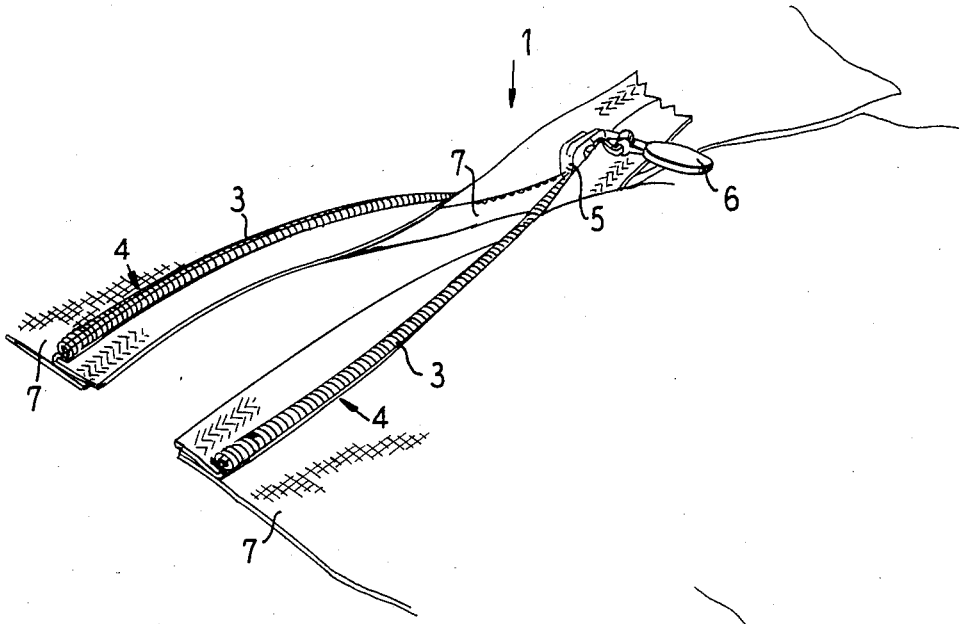
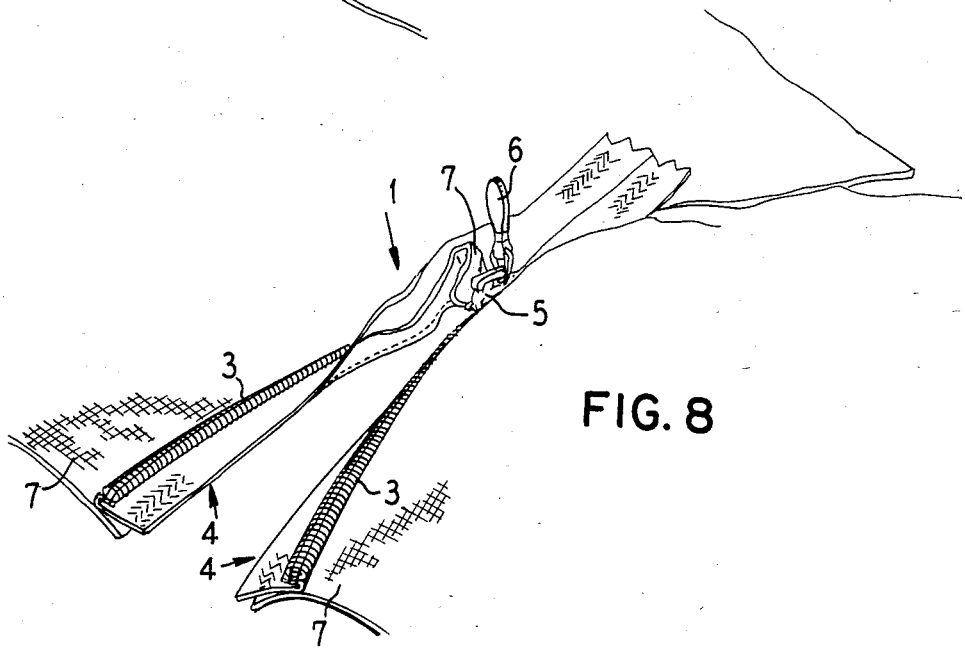
FIG. 8

METHOD AND APPARATUS FOR SEWING A SLIDE FASTENER TO FABRIC PIECES

BACKGROUND OF THE INVENTION

1. Field of the Invention

The present invention relates to a method of, and an apparatus for, sewing a slide fastener to a pair of fabric pieces, such as, for example, of a curtain, a tent or a lady's dress. It relates to the field of copending application for U.S. patent, Ser. No. 535,729 filed Sept. 26, 1983, now U.S. Pat. No. 4,497,270, dated Feb. 5, 1985.

2. Description of the Prior Art

As shown in FIGS. 1 and 2 of the accompanying drawings, a concealed slide fastener 1 comprises a pair of fastener stringers 4, 4, each stringer including a stringer tape 2 having an inner longitudinal edge folded on itself supporting a row of coupling elements 3 attached to the tape edge. The opposed rows of coupling elements 3, 3 are brought into and out of intermeshing engagement by a slider 5 which is slidably mounted on the rows of coupling elements 3, 3. The slider 5 has a slider body disposed on the coupling-element side of the concealed slide fastener 1 and a pull tab 6 pivotally connected to the slider body and projecting therefrom through the seam-like junction between the folded edges of the opposed stringer tapes 2,2.

Conventionally, for attaching the concealed slide fastener 1 to a pair of fabric pieces 7,7 (FIG. 3), on a sewing machine, the slider 5 is moved on the rows of coupling elements 3, 3 to a bottom end stop (not shown) to uncouple the opposed stringers 4,4 except at their bottom end portions. The uncoupled stringers 4, 4 are simultaneously sewn to the respective fabric pieces 7, 7 with sewn stitches 12, 12 along a pair of folding lines of the respective stringer tapes 2,2 as shown in FIG. 3. At that time, the folded tape edge of each stringer 4 is unfolded until the coupling elements 3 are erected with their head portions 10 directed downwardly, and the coupling elements 3 and the element-supporting tape edge of each stringer 4 are slidably received in a respective one of a pair of parallel downwardly opening grooves 8,8 in a presser foot 9 of the sewing machine. A pair of parallel sewing needles 11,11 are reciprocable through a pair of vertical holes in the presser foot 9. Also, during this sewing, the two stringers 4, 4 are superimposed over the respective fabric pieces 7,7 in such a manner that initially-outer (as seen in FIGS. 1 and 2) longitudinal edges of the opposed stringer tapes 2,2 are directed inwardly, i.e. toward each other.

This sewing operation is continued until the sewing stiches 12, 12 reach a position immediately short of the slider 5 disposed adjacent to the bottom end stop (not shown) of the slide fastener 1. As a result, the two stringers 4, 4 have been sewn to the respective fabric pieces 7,7 leaving the lower end portions of the stringers 4, 4 not sewn and hence floating from the fabric pieces 7,7.

As shown in FIGS. 4, 5 and 6, the sewn fabric pieces 7,7 are folded back on themselves about the sewn stiches 12, 12 as the two stringers 4,4 are progressively coupled together by moving the slider 5 from the bottom end stop (not shown) to a pair of top end stops (not shown) to close the concealed slide fastener 1. At that time, in order for their correct coupling, the two stringers 4, 4 need to assume proper twisted positions that are in mirror symmetry (FIG. 5).

Practically, however, because the lower end portion of the sewn slide fastener 1 is not sewn and hence floating from the fabric pieces 7,7, the opposed stringers 4,4 would tend to assume an improper twisted position that is not in mirror symmetry (FIG. 7), thus causing portions of the fabric pieces 7,7 to bulge inwardly between the two stringers 4,4 (FIG. 8). The bulged portions of the fabric pieces 7,7, can be caught by the slider 5 during the coupling of the two stringers 4,4; in such occurrence, the coupling of the two stringers 4,4 must be restarted after removing the caught fabric pieces 7,7 from the slider 5, which is laborious, time-consuming, and annoying.

Accordingly, this conventional method causes problems in the case where a plurality of the concealed slide fasteners 1 are successively sewn to successive pairs of the fabric pieces 7,7 and in which the sewn concealed slide fasteners 1 are temporarily stacked and are then supplied one after another to a finishing station where the opposed stringers 4,4 of each concealed slide fastener 1 are coupled by moving the slider 5.

SUMMARY OF THE INVENTION

It is an object of the present invention to provide a method and apparatus for sewing a slide fastener to a pair of fabric pieces, in which a pair of opposed fastener stringers with the fabric pieces sewn thereto can be coupled together smoothly and quickly without occurrence of any objectionable inward bulge of the fabric pieces between the opposed stringers.

Another object of the present invention is to provide a method and apparatus for sewing a plurality of slide fasteners one after another to successive pairs of fabric pieces, in which a pair of opposed fastener stringers of the individual slide fastener with the fabric pieces sewn thereto can be coupled together smoothly and quickly without occurrence of any objectionable inward bulge of the fabric pieces between the opposed stringers.

Other objects, features and additional advantages of the present invention will become manifest to those versed in the art upon making reference to the detailed description and the accompanying drawings in which a preferred embodiment incorporating the principles of the present invention is shown by way of illustrative example.

BRIEF DESCRIPTION OF THE DRAWINGS

FIGS. 7 and 8 are views similar to FIGS. 5 and 6, respectively, illustrating the prior problem;

DETAILED DESCRIPTION OF THE INVENTION

FIGS. 9 through 13 show an apparatus for sewing a concealed slide fastener 1 to a pair of fabric pieces 7,7.

Figure 9:
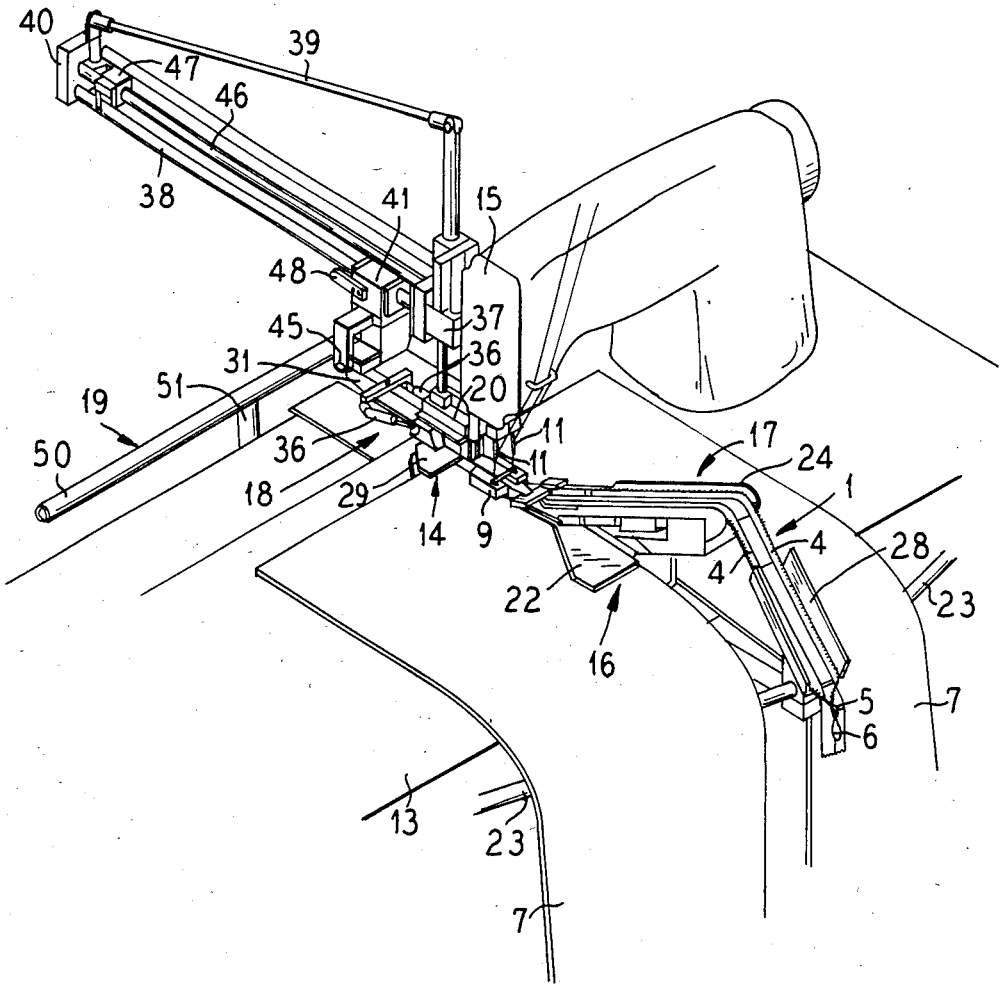
FIG. 9 is a fragmentary perspective view of a sewing apparatus embodying the present invention.

As shown in FIG. 9, the apparatus generally comprises a table 13, a sewing machine 15 mounted centrally on the table 13 and defining a sewing station 14, a fabric guide 16 supported on the table 13 upstream of the sewing station 14, a slide-fastener guide 17 supported on the table 13 and disposed above the fabric guide 16, a gripper mechanism 18 mounted on the table downstream of the sewing station 14 for horizontal linear movement, a stacker 19 disposed beneath the gripper mechanism 18, a sewn-product guide 20 disposed downstream of the sewing station 14 for vertical movement, and a slider-moving unit 21 (FIGS. 10 and 11) disposed beneath the sewn-product guide 20 for horizontal linear movement.

Figure 1:
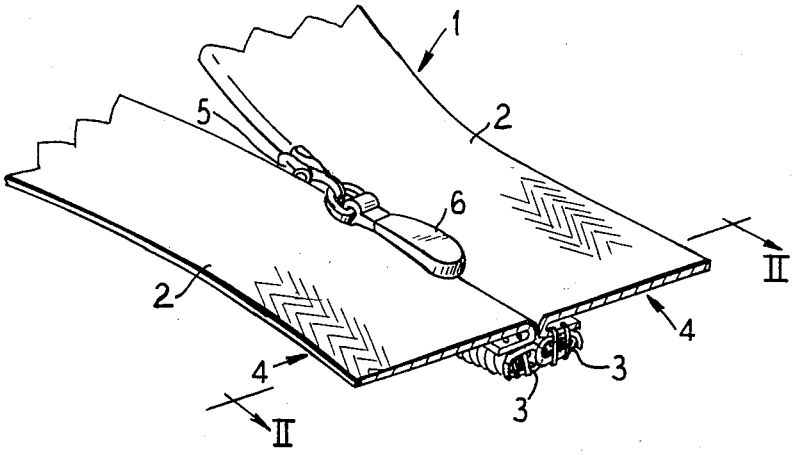
FIG. 1 is a fragmentary perspective view of a concealed slide fastener.
Figure 2:
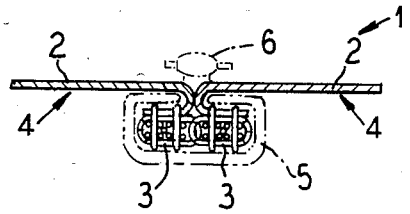
FIG. 2 is a transverse cross-sectional view taken along line II—II of FIG. 1.
Figure 3:
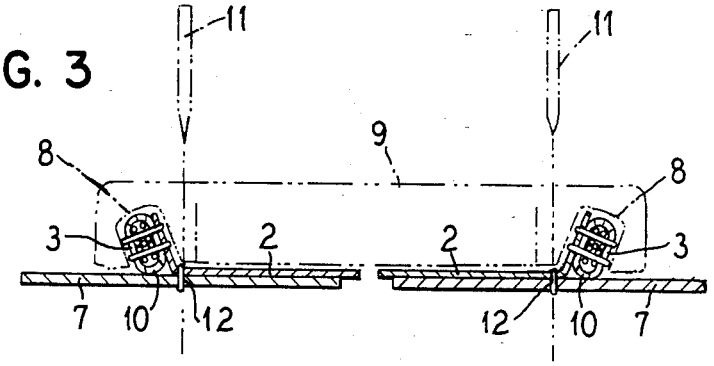
FIG. 3 is a transverse cross-sectional view of a pair of uncoupled and unfolded fastener stringers, illustrating the manner in which the two stringers are sewn to a pair of fabric pieces, respectively, on a sewing machine.
Figure 4:
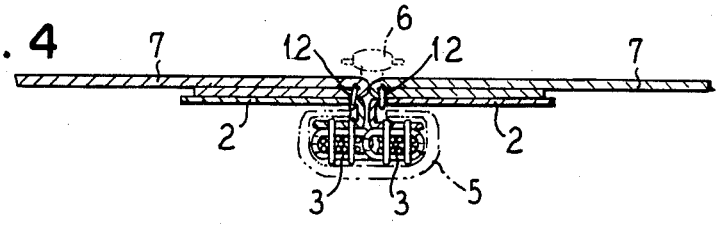
FIG. 4 is a transverse cross-sectional view of the opposed stringers sewn to the respective fabric pieces and coupled together by a slider.
Figure 5:
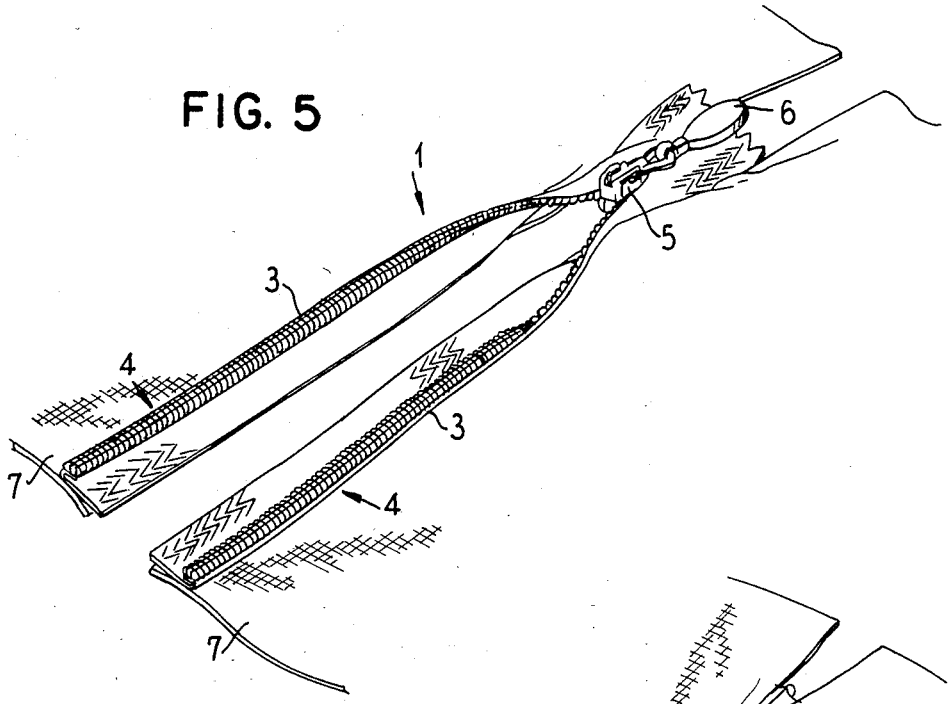
FIG. 5 is a fragmentary perspective view of the concealed slide fastener sewn to the fabric pieces, with the opposed stringers uncoupled.
Figure 6:
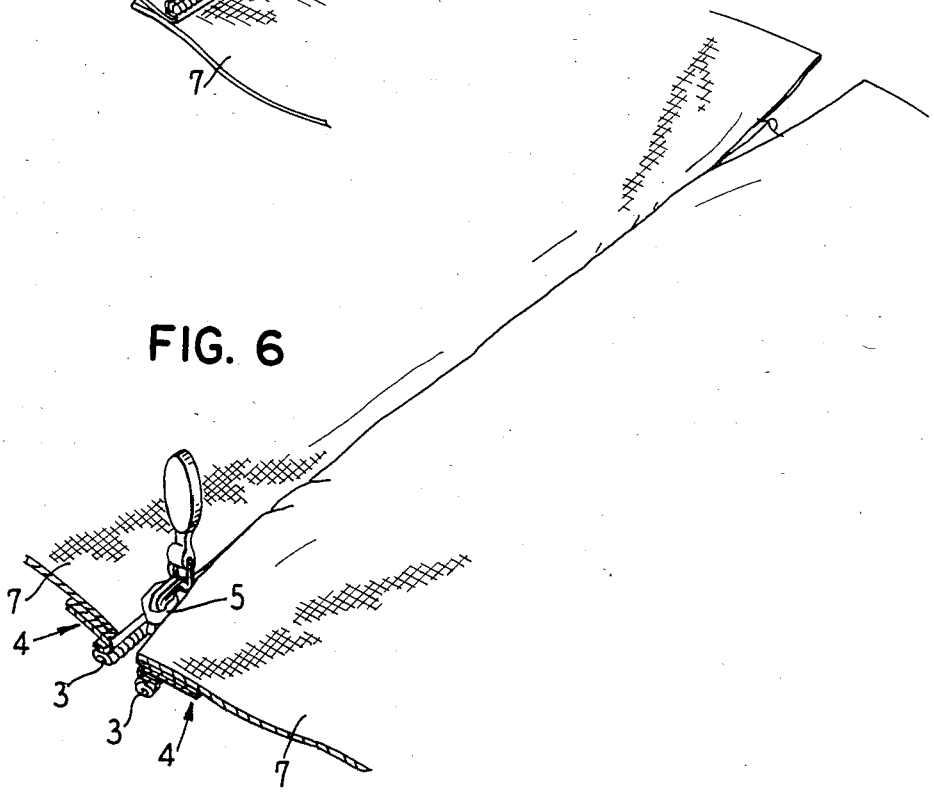
FIG. 6 is a fragmentary perspective view of the sewn slide fastener of FIG. 5, closed by the slider.

The sewing machine 15 may be a conventional type on the market. It includes a presser foot 9, a pair of feed dogs (not shown), and a pair of sewing needles 11,11. As shown in FIG. 3, the presser foot 9 has in its bottom surface a pair of parallel grooves 8, 8, each receptive of an inner longitudinal edge of the respective stringer tape 2 together with a row of coupling elements 3 attached thereto. Upon depression of a start button (not shown), the presser foot 9 is lowered and then the sewing of the concealed slide fastener 1 and the fabric pieces 7,7 in "lock stitch" takes place. This lock-stich sewing is followed by back-tucking, cutting the sewing threads and raising of the presser foot in this order. The details of the sewing machine 15 itself are not pertinent here and its detailed description is omitted for clarity. As better shown in FIGS. 9 AND 10, the fabric guide 16 includes a pair of transparent horizontal guide plates 22, 22 spaced from the upper surfaces of the table 13 by a gap substantially equal to the thickness of the individual fabric piece 7, and a pair of guide rods 23, 23 mounted on the front or upstream side of the table 13. The pair of convergent guide rods 23, 23 lie in a horizontal plane substantially coplanar to the upper surface of the table 13. As the pair of fabric pieces 7, 7 are supplied to the sewing station 14, each fabric piece 7 is supported on the respective guide rod 23 and is then introduced into the gap between the corresponding guide plate 22 and the table 13.

As shown in FIGS. 9, 10, 12 and 13, the slide-fastener guide 17 includes an elongated flanged guiding plate 24 sloping downwardly toward the sewing station 14 and an elongated flanged auxiliary guiding plate 28 disposed upstream of the guiding plate 24 and sloping upwardly toward the guide plate 24, for guiding the substantially uncoupled stringers 4, 4 over the two guiding plates 24,28.

Figure 10:
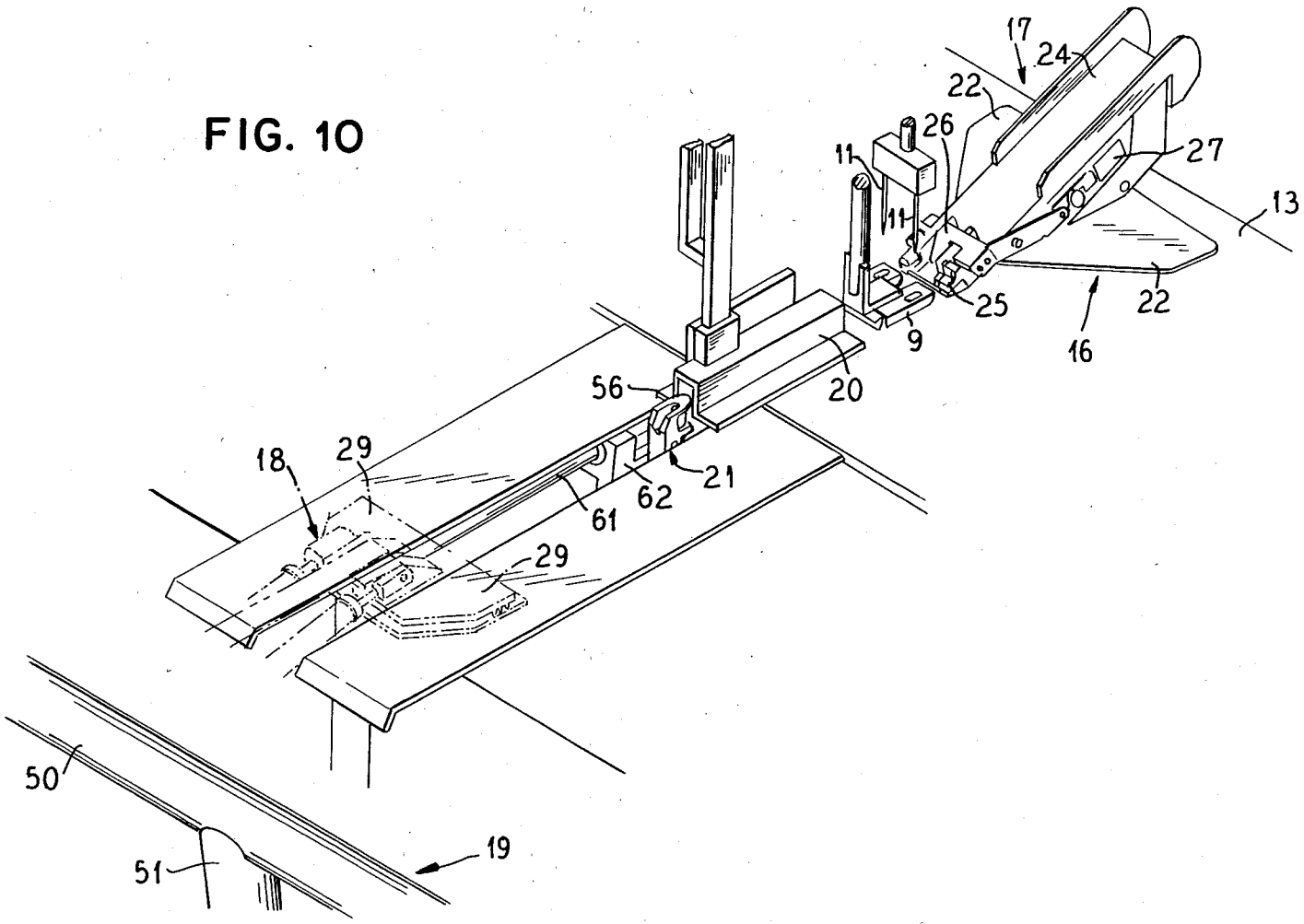
FIG. 10 is another perspective view, with parts omitted, of the apparatus shown in FIG. 9.

As shown in FIG. 10, the slide-fastener guide 17 also includes a pair of spaced track bodies 25,25 mounted on the guiding plate 24 at one end thereof adjacent to the sewing station 14 for guiding the respective coupling element rows 3,3 in such a manner that each coupling element row 3 assumes an erected position. A slider detector 26 is mounted on the guiding plate 24 and is pivotable vertically between the two track bodies 25,25 when the slider 5 on the concealed slide fastener 1 passes through the space between the two track bodies 25,25. The detector 26 is associated with a microswitch 27 which is operative, in response to the pivotal movement of the detector 26, to terminate the advance of the slide fastener 1.

The purposes of the gripper mechanism 18 are to keep the tension of both the slide fastener 1 and the fabric pieces 7,7 to a constant degree during the sewing, thus not only causing a uniform rate of sewing but making the sewn stiches 12, 12 aligned with the respective folding lines of the opposed stringers 4,4. The gripper mechanism 18 also serves to quickly discharge the sewn product, i.e., the slide fastener 1 with the fabric pieces sewn thereto.

As shown in FIGS. 9, 11, 12 and 13, the gripper mechanism 18 includes a pair of laterally spaced grippers 29,29, each gripper 29 being composed of an upper grip member 33 and a lower grip member 30. The lower grip member 30 is secured to a horizontal connector 31 in the form of a rod and is disposed slightly above the upper surface of the table 13. The upper grip member 33 is pivotally connected to the connector 31 near the downstream end of the lower grip grip member 30 by a pin 32. The upper grip member 33 is also connected to an air cylinder 36 via a link 34 which is connected to a piston rod 35 of the air cylinder 36. Two such air cylinders 36 are pivotally mounted on the connector 31 remotely from the grippers 29,29. Upon energization or de-energization of the two air cylinders 36,36, each piston rod 35 projects or is retracted to close or open its respective gripper 29.

Fixed to the downstream side of the sewing machine 15 is a holder 37 from which a guide rail 38 extends horizontally in the direction of discharging the sewn product. A free end of the guide rail 38 is fixed to a bracket 40 supported by a hanger rod 39. A slider 41 is slidably mounted on the guide rail 38. As better shown in FIGS. 12 and 13, an endless belt 44 is wound about a pair of pulleys 42,43 rotatably mounted on the holder 37 and the bracket 40, respectively, the endless belt 44 being fixed to the slide 41. The pulley 42 is connected to a servo motor (not shown) which drives the slide 41 selectively forwardly (downstream) and backwardly (upstream) and which changes the rate of movement of the slide 41 depending on the load. The downstream end of the connector 31 of the gripper mechanism 18 is integrally connected to a transverse shaft 45 rotatably supported by the slide 41.

The backward or upstream movement of the slide 41 is limited by a stop (not shown) projecting therefrom and engageable with the holder 37; thus the backward movement of the two grippers 29, 29 terminates in a retracted position close to the sewing station 14. At that time, the approach of the slide 14 is detected by a proximity switch (not shown) which issues a signal to reduce the rate of rotation of the non-illustrated servo motor, and the arrival of the slide 41 is detected by a limit switch (not shown) which has an actuator engageable with the non-illustrated stop and which is responsible to this engagement to issue a signal to terminate the rotation of the non-illustrated servo motor. The forward or downstream movement of the slide 41 is limited by a contact member 48 extending therefrom and engageable with an actuator of a microswitch 47 which is adjustably mounted on a support rod 46 extending between the holder 37 and the bracket 40 in parallel relationship to the guide rail 38.

Upon its actuation, the microswitch 47 produces a signal to stop the rotation of the servo motor, thus terminating the forward movement of the slide 41. As a result, the forward movement of the two grippers 29, 29 terminates in an advanced position, which is adjustable by changing the position of the microswitch 47 on the support rod 46.

The transverse shaft 45 is operatively connected to a drive, such as a motor or an air cylinder, for turning the transverse shaft 45 through a predetermined angle about its axis. In response to clockwise turning of the transverse shaft 45, the connector 31 of the gripper mechanism 18 is angularly movable about the transverse shaft 45 in the direction of an arrow b from the position (horizontal), of FIG. 12 to the position (vertical in this embodiment) of FIG. 13. This arrangement is particularly useful when a relatively long sewn product 49 is to be discharged without elongating the guide rail 38.

As shown in FIGS. 9, 10, 12 and 13, the stacker 19 is disposed beneath the gripper mechanism 18 for receiving the successive sewn products 49 (released from the gripping mechanism 18 as described below) one over another and for discharging a stack of the sewn products 49 out of the apparatus when the stack reaches a predetermined amount.

The stacker 19 includes a generally T-shaped hanger having a horizontal pipe 50 connected to an upper end of an arm 51 pivotally mounted on a base beneath the table 13. An air cylinder 52 is pivotally supported by the base, and a piston rod 53 of the air cylinder 52 is pivotally connected to the arm 51 at a midportion thereof. In timed relation to the forward movement of the two grippers 29, 29, the piston rod 53 of the air cylinder 52 projects to cause the stacker 19 to pivotally move in the direction of an arrow d in FIG. 13 from a retracted position (solid lines) to an advanced position (dash-and-dot lines) where the sewn product 49 released from the grippers 29, 29 is received on the transverse pipe 50. Thereafter, when the piston rod 53 of the air cylinder 52 is retracted, the stacker 19 is returned in the direction of an arrow e in FIG. 13 to its original or retracted position, with the sewn product 49 hanging on the transverse pipe 50.

Figure 11:
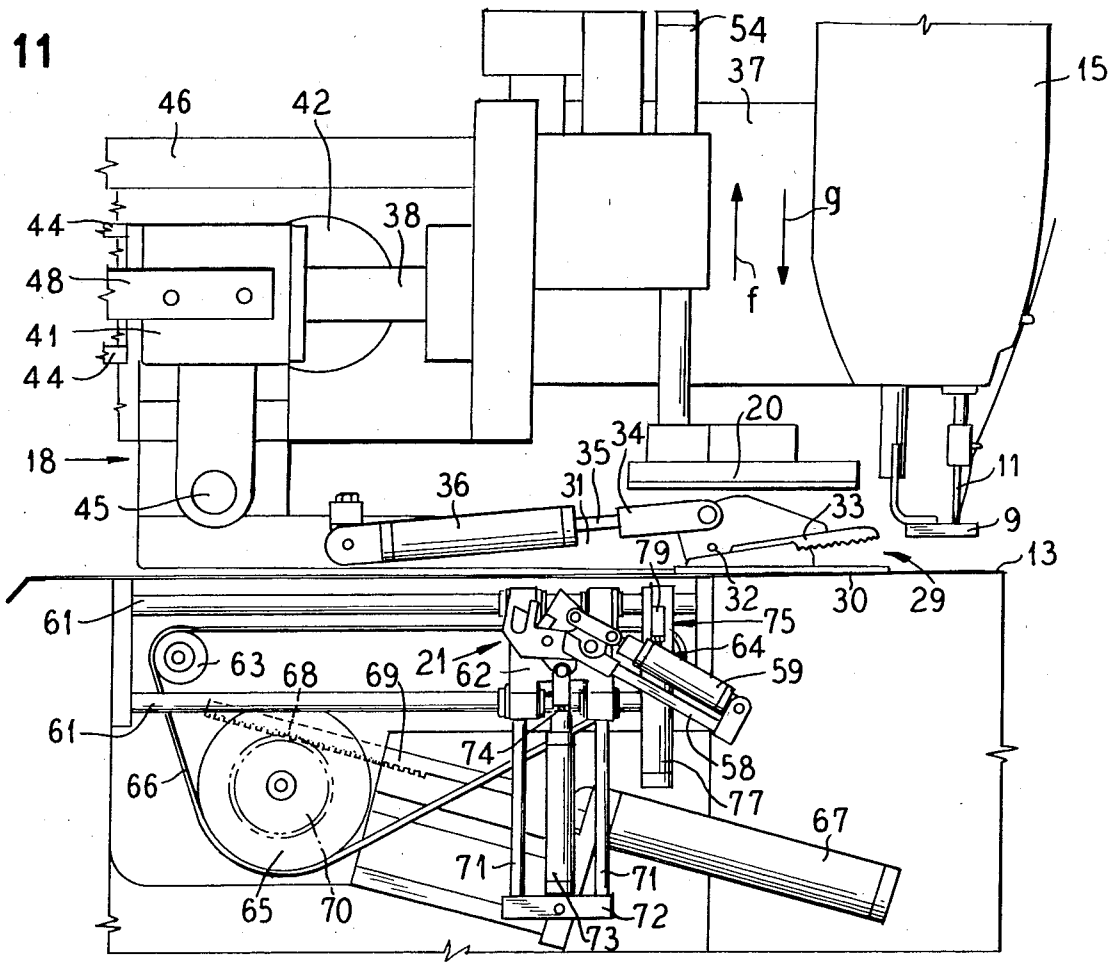
FIG. 11 is a side elevational view, with parts omitted of the apparatus, showing a slider-moving unit in detail.
Figure 12:
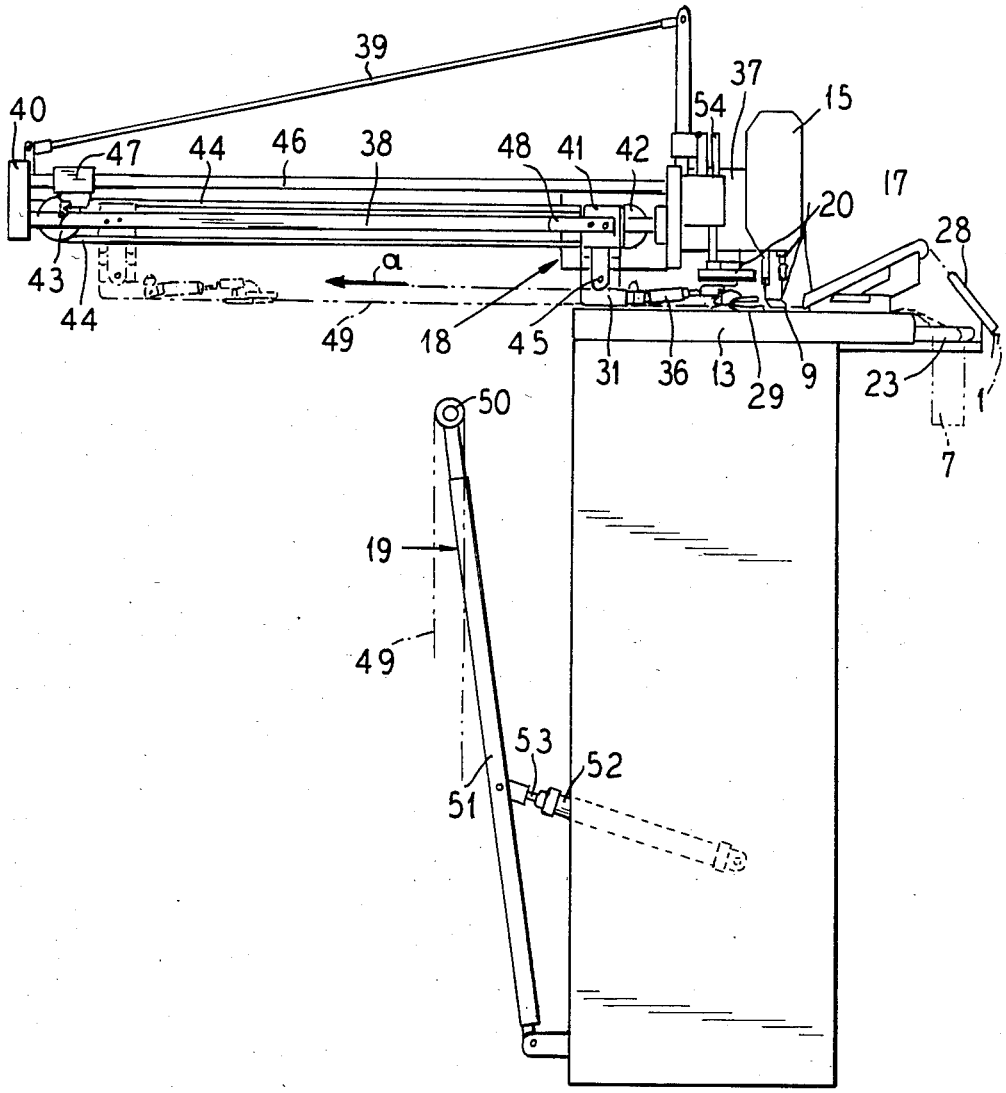
FIG. 12 is a fragmentary side elevational view, on a reduced scale, of FIG. 11.
Figure 18A:
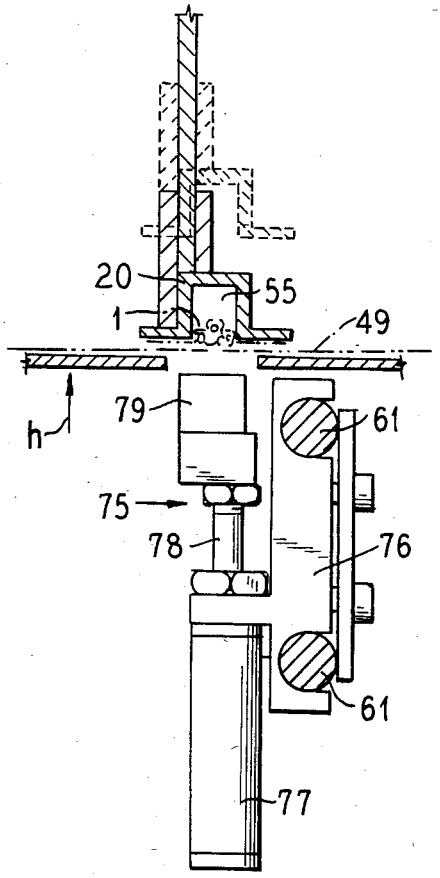
FIGS. 18A and 18B are cross-sectional views illustrating the operation of a brake.
Figure 18B:
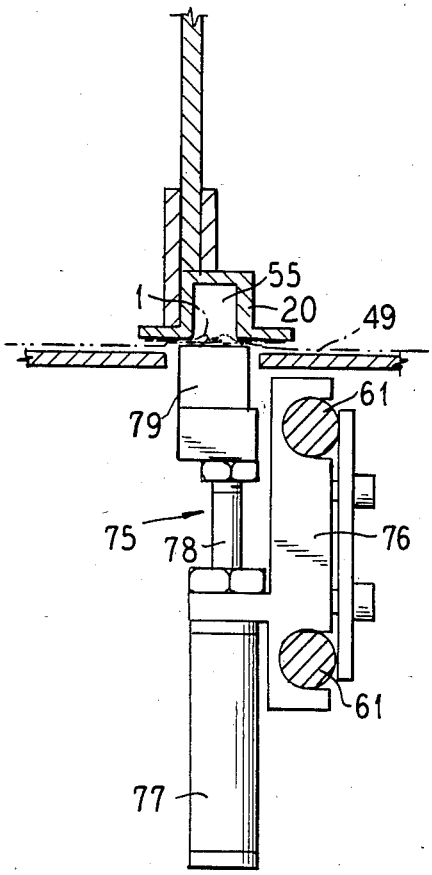

As shown in FIGS. 10 and 11, the finished-product guide 20 is disposed downstream of the sewing station 14 and is vertically movable in the direction of arrows f and g by means of an air cylinder 54 supported by the holder 37. The finished-product guide 20, as shown in FIGS. 18A and 18B, has a downwardly opening guide channel 55. When the sewn product 49 is pulled forwardly by the gripper mechanism 18, the sewn-product guide 20 is lowered from the dash-and-dot-line position to the solid-line position in FIG. 18A and the slider 5 (disposed at the lower end portion of the sewn product 49) is guided along the guide channel 55 of the guide to the slider-moving unit 21. While the slide fastener 1 is being sewn to the pair of fabric pieces 7,7, the guide 20 is in raised position, as shown in FIG. 10, so as not to obstruct the movement of the gripper mechanism 18.

The slider-moving unit 21, as shown in FIGS. 10 and 11, is disposed immediately downstream of the sewn-product guide 20 for linear movement to move the slider 5 from the bottom end stop (not shown) of the sewn slide fastener 1 toward the top end stops (not shown) to couple the opposed stringers 4,4 through a predetermined length. As a result, the slider 5 has been moved to the region where the slide fastener 1 is sewn to the fabric pieces 7,7.

The thus partly closed product 49 is discharged out of the apparatus, and then the slider 5 can be moved all the way to the top end stops of the slide fastener 1 smoothly to provide a fully closed concealed slide fastener 1 sewn to a pair of fabric pieces 7,7.

As better shown in FIGS. 14 to 17, the slider-moving unit 21 includes a slider catch 56 of a generally C-shape opening backwardly for receiving the slider 5, and a retainer 57 pivotally mounted on a lower portion of the catch 56 for retaining the slider 5 in the catch 56. The catch 56 has a support rod 58 extending substantially downardly (FIGS. 14, 16, and 17) from the lower portion of the catch 56 at an angle thereto and terminating in a block on which an air cylinder 59 is pivotally mounted. Piston rod 60 of the air cylinder 59 is pivotally connected to the retainer 57. As the piston rod 60 of the air cylinder 59 projects (FIGS. 17), the retainer 57 is pivotally moved counterclockwise from the position of FIG. 16 to the position of FIG. 17 to push the slider body 5 against the catch 56, thus preventing the slider 5 from being removed from the catch 56. On the contrary, as the piston rod 60 of the air cylinder 59 is retracted (FIG. 16), the retainer 57 is pivotally moved clockwise from the position of FIG. 17 to the position of FIG. 16 so that the slider 5 can be removed from the catch 56.

As shown in FIG. 11, a slide 62 is slidably mounted on a pair of parallel horizontal guide rails 61,61 which is supported by the base (of the apparatus) beneath the table 13. An endless belt 66 is wound around a pair of small-sized upper pulleys 63,64 and a large-sized lower pulley 65 (all of the pulleys are rotatable on the base) and is fixed to the slide 62. The two small-sized pulleys 63, 64 are disposed between the two guide rails 61,61 and are spaced away from each other along the guide rails 61, while the large-sized pulley 65 is disposed below the guide rails 61.

The large-sized pulley 65 has a coaxial pinion 70 meshing with a rack 68 formed on a piston rod 69 of an air cylinder 67 which is pivotally supported by the base.

As the pinion 70 and thus the large-sized pulley 65 is rotated counterclockwise in response to extension of the rack piston rod 69 of the air cylinder 67, the slider 62 is moved forwardly leftwardly away from the sewing station 14 along the guide rails 61,61. Reversely, as the large-sized pulley 65 is rotated clockwise in response to shrinking of the racked piston rod 69 of the air cylinder 67, the slider 62 is then moved backwardly, i.e., rightwardly toward the sewing station 14 along the guide rails 61,61.

The slider catch 56 is pivotally mounted on the slide 62 and is reciprocable, in response to the reciprocating movement of the slide 62, for pulling the slider 5 forwardly along the opposed stringers 4,4 to close the sewn slide fastener 1 while the opposite end portions of the slide fastener 1 is held in position in a manner described below.

The slide 62 has a pair of parallel support rods 71, 71 extending downwardly from a lower end portion of the slide 62 and interconnected at their lower ends by a horizontal connector 72. An air cylinder 73 is pivotally supported centrally on the horizontal connector 72, and a piston rod 74 of the air cylinder 73 is pivotally connected to the slider catch 56. As the piston rod 74 of the air cylinder 73 is retracted (FIG. 15), the catch 56 is pivotally moved counterclockwise from the position of FIG. 16 to the position of FIG. 15 below the table 13 so as not to impede not only the movement of the gripper mechanism 18 but the discharging of the sewn-product 49. Reversely, as the piston rod 74 of the air cylinder 73 is extended, the catch 56 is pivotally moved clockwise from the position of FIG. 15 to the position of FIGS. 16 and 17 to project above the upper surface of the table 13. The slider 5 is received in the catch 56 (FIG. 16) and is then retained therein by the retainer 57 (FIG. 17), whereupon the forward or downstream movement of the catch 56 is started.

As shown in FIG. 11, the brake 75 is supported on the pair of guide rails 61,61 at a fixed position adjacent to their upstream ends to temporarily stop the forward movement of the sewn product 49 to thereby facilitate the forward movement of the slider 5 on the sewn slide fastener 1 by the slider-moving unit 21.

As better shown in FIGS. 18A and 18B, the brake 75 includes a bracket 76 fixed to the guide rails 61,61, an air cylinder 77 supported by the bracket 76, and a pressing member 79, in the form of a thin plate (FIGS. 20A to 20G), to which a piston rod 78 of the air cylinder 77 is connected. As the piston rod 78 of the air cylinder 77 is extended, the pressing member 79 is raised in the direction of an arrow h from the position of FIG. 18A to the position of 18B for pressing the bottom end portion of the slide fastener 1 against the lower surface of the product guide 20. To the contrary, as the piston rod 78 of the air cylinder 77 is retracted, the pressing member 79 is returned to its original or lowered position (FIG. 18A) for releasing the sewn product 49.

The manner in which a concealed slide fastener 1 is sewn to a pair of fabric pieces 7,7 on the apparatus of FIGS. 9–17 and 18A–18B will be described hereinbelow in connection with FIGS. 19A–19F and 20A–20G.

Figure 19A:
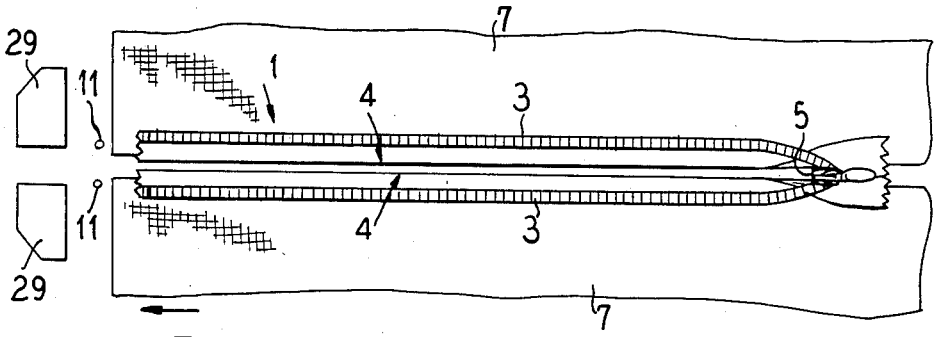
FIGS. 19A to 19F are plan views of a concealed slide fastener, each illustrating successive steps of the present sewing method relative thereto.
Figure 19B:
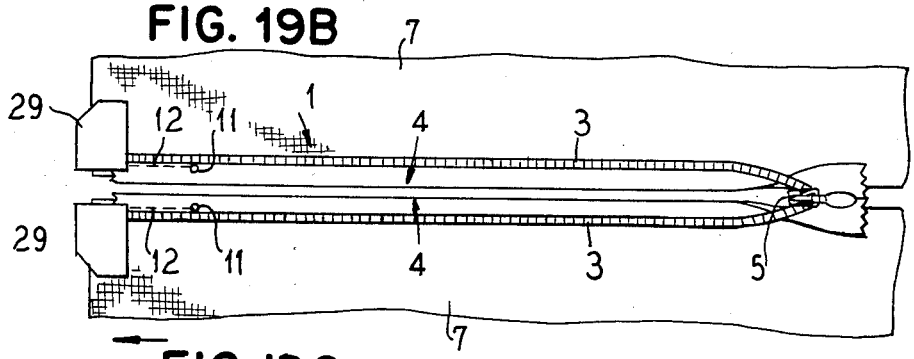

As shown in FIG. 19A, before the start of sewing work, a pair of fabric pieces 7,7 is introduced into the sewing station 14 (only the two sewing needles 11,11 are illustrated in FIGS. 19A–19F), while a concealed slide fastener 1 is fully opened by moving the slider 5 and then the uncoupled stringers 4,4 are turned upside down through the entire length of the slide fastener 1 except the bottom end portion thereof. Thus, the two turned stringers 4,4 assume twisted positions in mirror symmetry. The concealed slide fastener is introduced into the sewing station 14, with the opposed stringers 4,4 superimposed over the respective fabric pieces 7,7.

More specifically, in introducing the fabric pieces 7,7 into the sewing station 14, each fabric piece 7 passes over the respective guide rod 23 and then through the gap between the corresponding guide plate 22 and the upper surface of the table 13, as shown in FIG. 9. On the other hand, the concealed slide fastener 1 is opened manually and is then placed over the guide plate 24 while turning the uncoupled stringers 4,4 upside down, as shown in FIG. 9. Then the leading end portion of each stringer 4 is introduced into the sewing station 14 via the respective track body 25. In the sewing station 14, the leading end portion of each stringer 4 is superimposed over the respective fabric piece 7 in such a manner that the coupling elements 3 are erected with the head portions 10 directed downwardly. At that time, as shown in FIG. 11, the gripper mechanism 18 is disposed at a position near the presser foot 9 in the sewing station 14, with each gripper 29 open. The sewn-product guide 20 is in raised position so as not to interfere with the gripper mechanism 18, as shown in FIG. 11. The slide-moving unit 21 is in retracted position near the sewing station 14, the slider catch 56 being retracted below the table 13. The brake 75 is also lowered or retracted below the table 13.

Figure 20A:
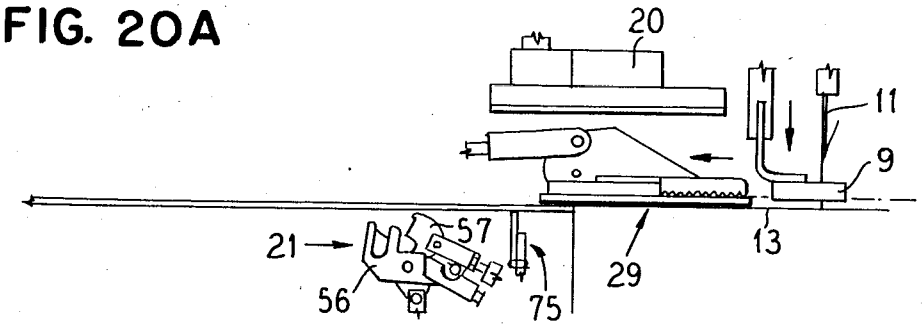
FIGS. 20A to 20G are side elevational views corresponding to FIGS. 19A to 19F, illustrating the sequence of steps of operation of the apparatus.

When a start button (not shown) is depressed, the presser foot 9 and the sewing needles 11,11 are lowered to start sewing work. As the sewing work progresses, both the leading end portion of each fabric piece 7 and the leading end portion of the corresponding stringer 4 are advanced between the upper and lower grip members 33, 30 of the respective gripper 29, as shown in FIG. 9B. The arrival of the leading ends of the fabric pieces 7,7 and the stringers 4,4 is detected by a photosensor (not shown) disposed at a suitable position in the sewing station 14. The photosensor is responsive to this arrival to issue a command signal to the air cylinder 36, wherupon the piston rod 35 is extended to cause each gripper 29 to grip the superimposed end portions of the respective fabric piece 7 and the corresponding stringer 4, as shown in FIG. 20A. The grippers 29 pull the sewn product 49 forwardly to discharge the same from the sewing station 14 under a constant tension smaller than the tension under which the sewn product 49 is advanced by the feed dog (not shown) of the sewing machine 15. This discharging tension is automatically controlled by the non-illustrated servo motor that is the drive source for moving the slider 41 of the gripper mechanism 18.

Figure 20B:
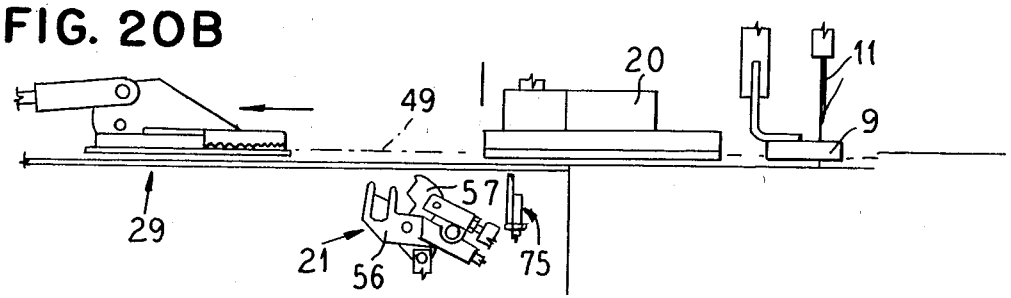
Figure 20C:
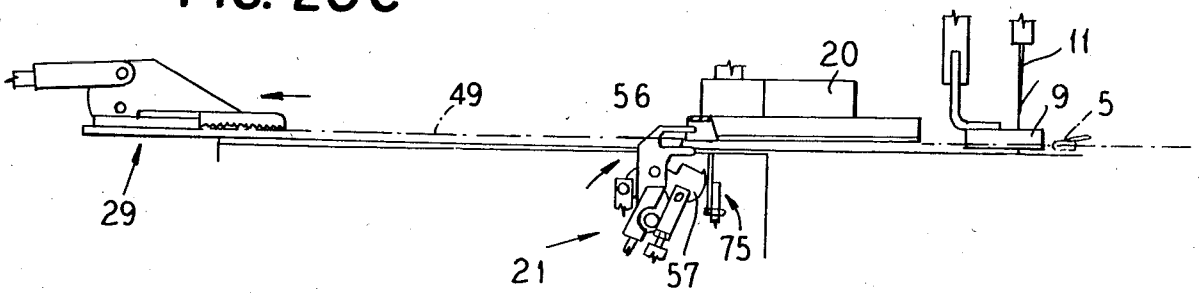

When the grippers 29,29 as the sewing work further progresses, are removed from the region where both the sewn-product guide 20 and the slider-moving unit 21 are located, the sewn-product guide 20 is lowered and the slider catch 56 of the slider-moving unit 21 projects above the upper surface of the table 13, as shown in FIGS. 20B and 20C.

Figure 19C:
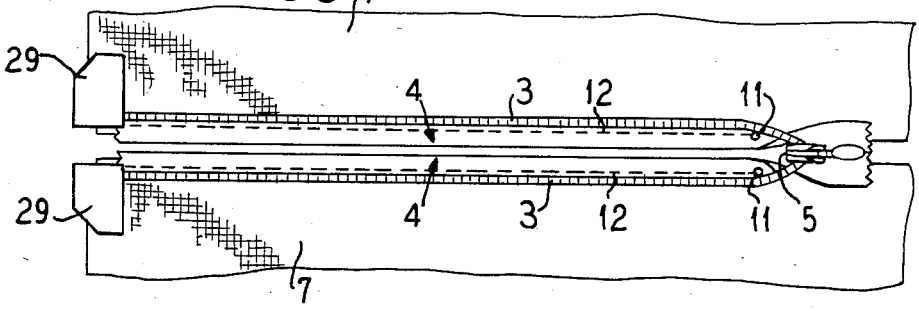
Figure 19D:
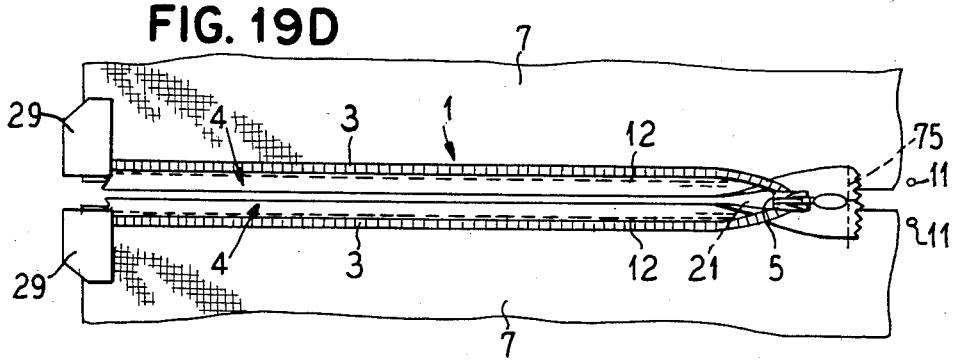

Subsequently, when the slider 5 disposed at the bottom end portion of the slide fastener 1 arrives at the slider detector 26, the detector 26 is pivotally moved upwardly to actuate the microswitch 27 associated therewith, whereupon the microswitch 27 issues a command signal to the sewing machine 15 to start back tucking. The sewing threads are cut and the presser foot 9 is then raised to terminate the operation of the sewing machine 15. As shown in FIG. 19C, the sewn stitches 12 extend from the leading end of the slide fastener 1 and terminate just short of the slider 5 disposed at the bottom end portion of the slide fastener 1, thus leaving the bottom end portions of the opposed stringers 4,4 not sewn, and hence floating, from the fabric pieces 7,7.

After the sewing operation of the sewing machine 1 is stopped, the gripper mechanism 18 is continued to discharge the sewn product 49 that has been removed from the sewing station 14.

Figure 20D:
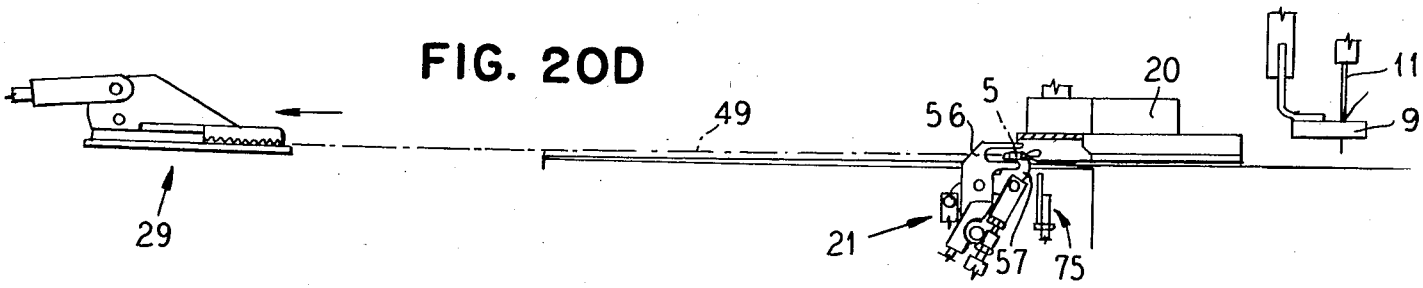

With continued discharging of the sewn product 49 by the gripper mechanism 18, the bottom end portion of the sewn slide fastener 1, including the slider 5, is introduced into the sewn-product guide 20. Then the slider 5 of the sewn slide fastener 1 is blocked or caught by the slider catch 56 of the slider-moving unit 21, as shown in FIG. 20D. This blocking is detected by a photosensor (not shown) which then issues a command signal to energize the air cylinder 59, (FIGS. 16 and 17), causing the retainer 57 to pivot to keep the slider body 5 in the catch 56.

Upon receipt of the slider 5 in the catch 56, the forward movement of the gripper mechanism 18 is stopped and the operation of the brake 75 is started. Thus, the leading end of the sewn product 49 is held in position by the grippers 29, 29 and the bottom end portion of the slide fastener 1 is held in position by the brake 75, giving the concealed slide fastener 1 a constant tension.

Figure 19E:
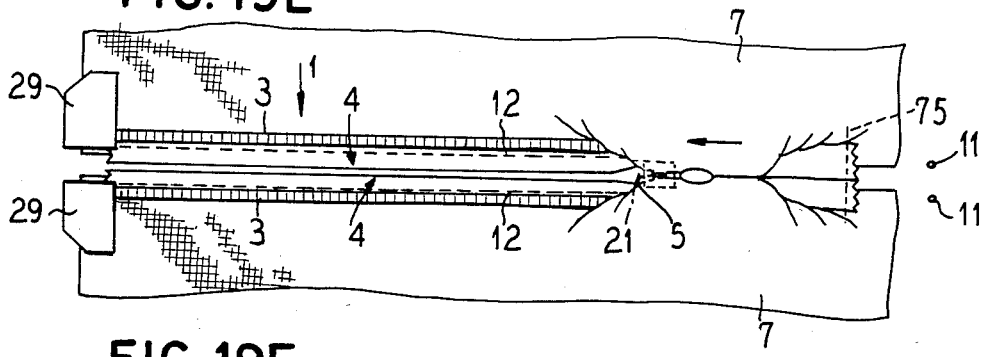
Figure 20E:
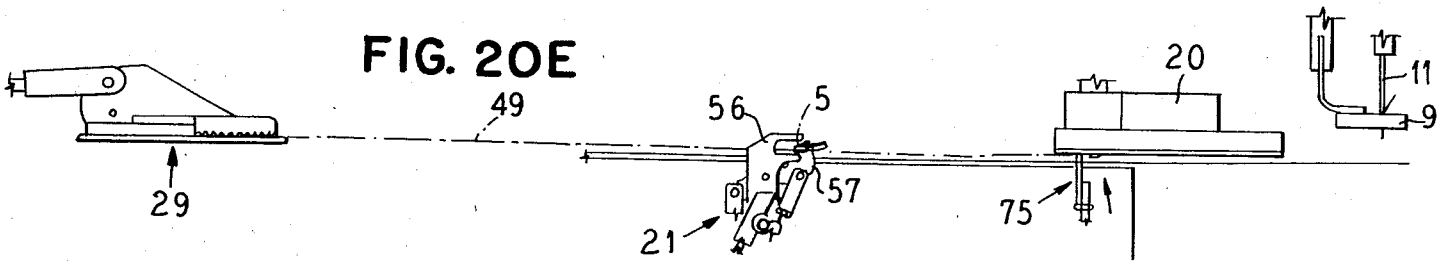
Figure 20F:
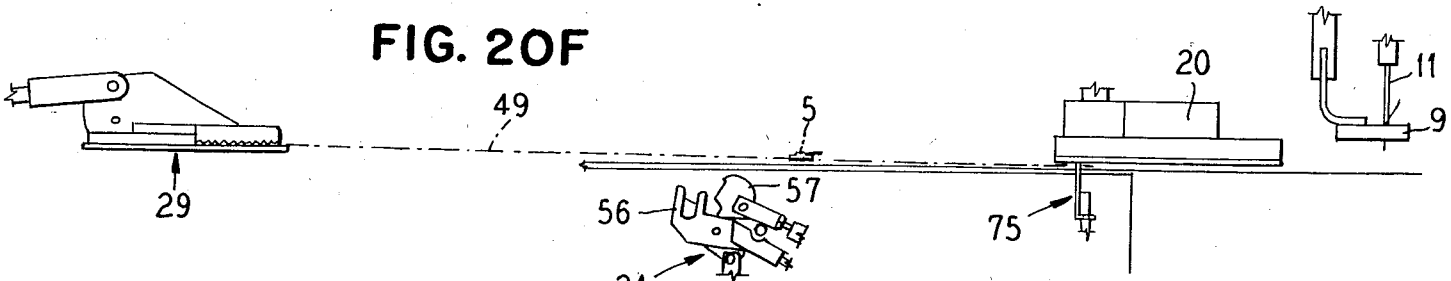

While the sewn product 49 is thus kept from moving, as shown in FIGS. 19E and 20E, the slider-moving unit 21 is moved fowardly by the action of the air cylinder 67 (FIG. 11) to pull the slider 5 along the uncoupled stringers 4,4 to partly close the sewn slide fastener 1. This pulling is continued until the slider 5 is moved into the region where each stringer 4 and the corresponding fabric piece 7 are sewn. Then, as shown in FIG. 20F, the retainer 57 is returned to its original or retracted position to release the slider 5 and the slider catch 56 is retracted below the table 13, during which time the brake 75 is continued to be operative.

Figure 13:
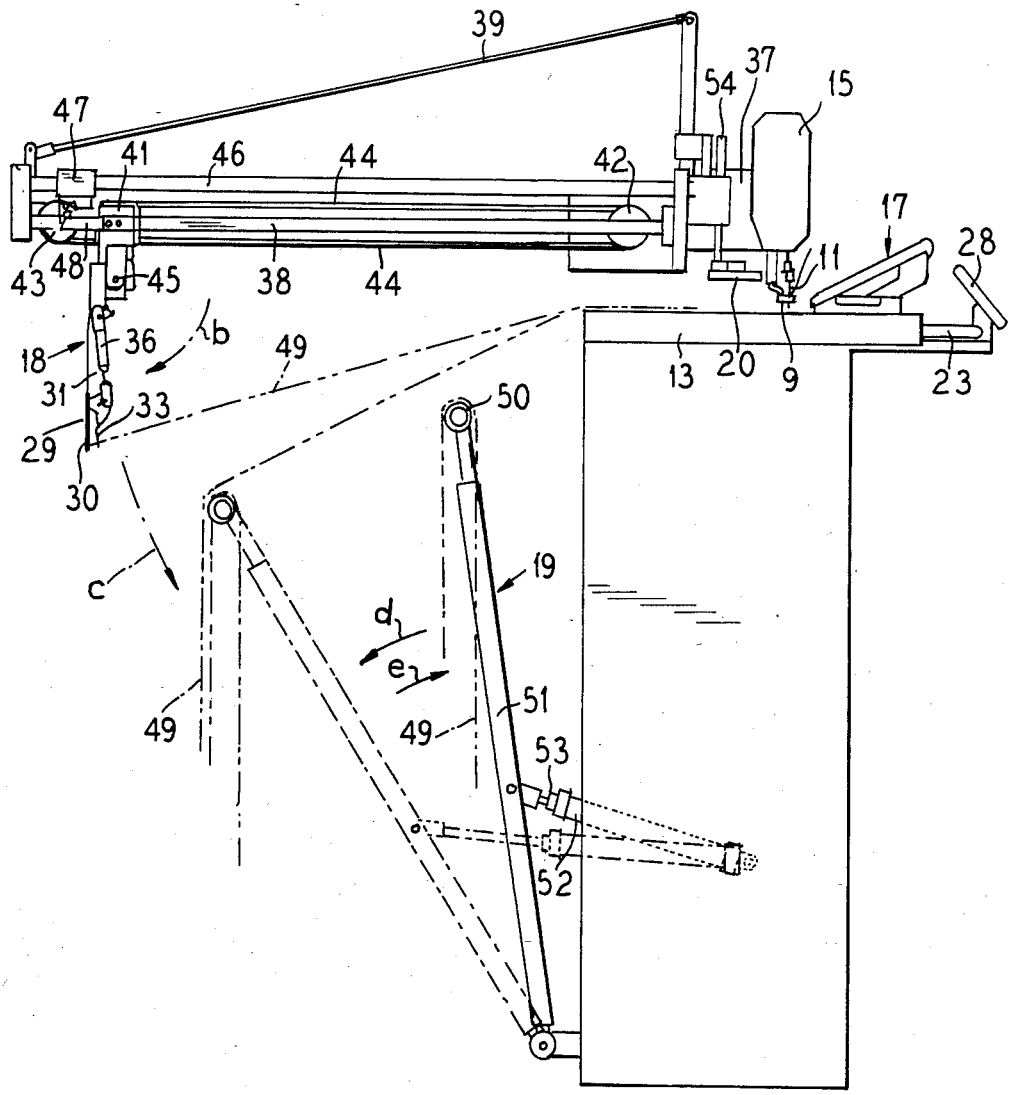
FIG. 13 is a view similar to FIG. 12, illustrating the operations of a gripping mechanism and a stacker.
Figure 14:
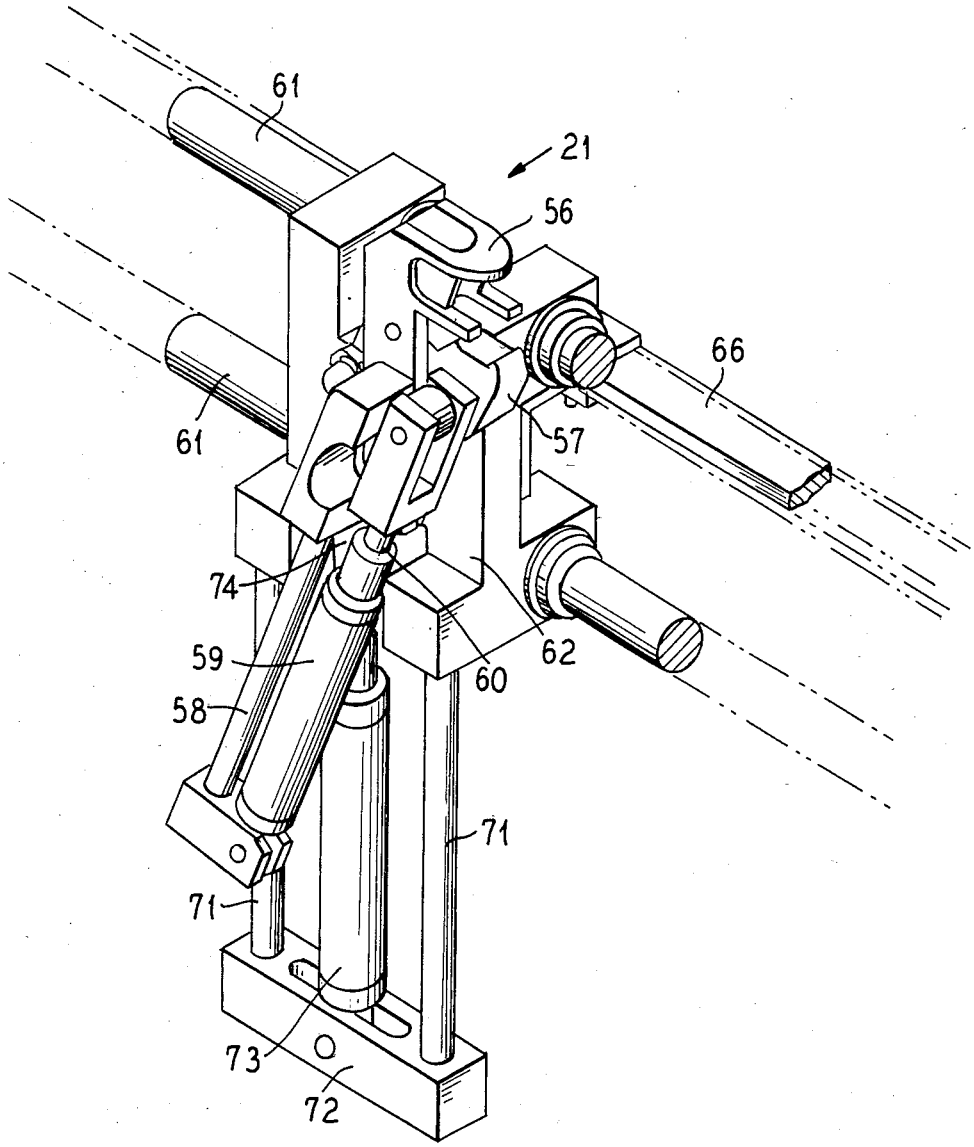
FIG. 14 is an enlarged perspective view, with parts omitted, of the slider-moving unit.
Figure 17:
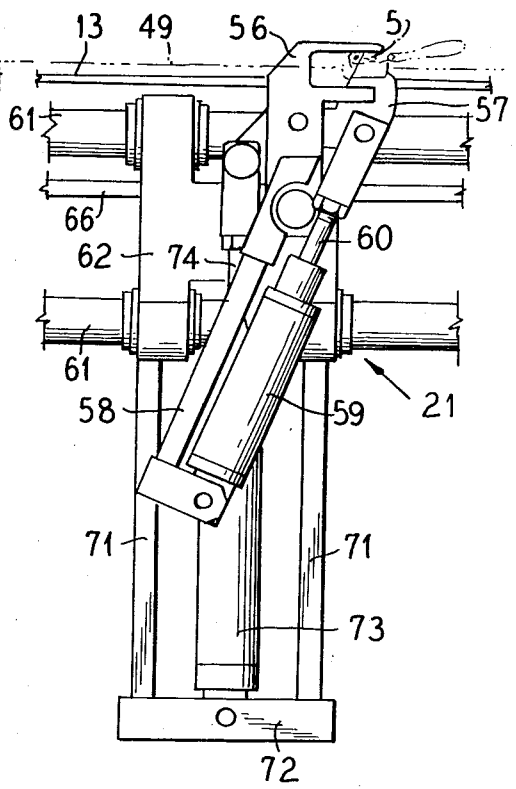
FIGS. 15 to 17 are side elevational views of FIGS. 14, illustrating the operation of the slider-moving unit.
Figure 16:
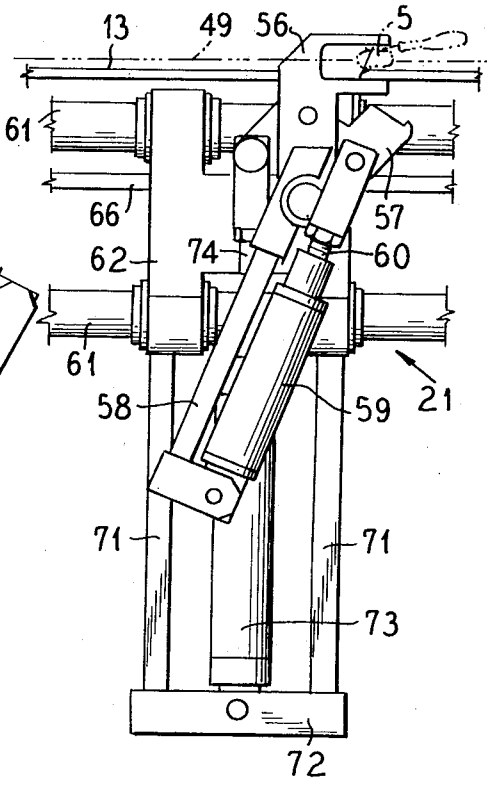
Figure 15:
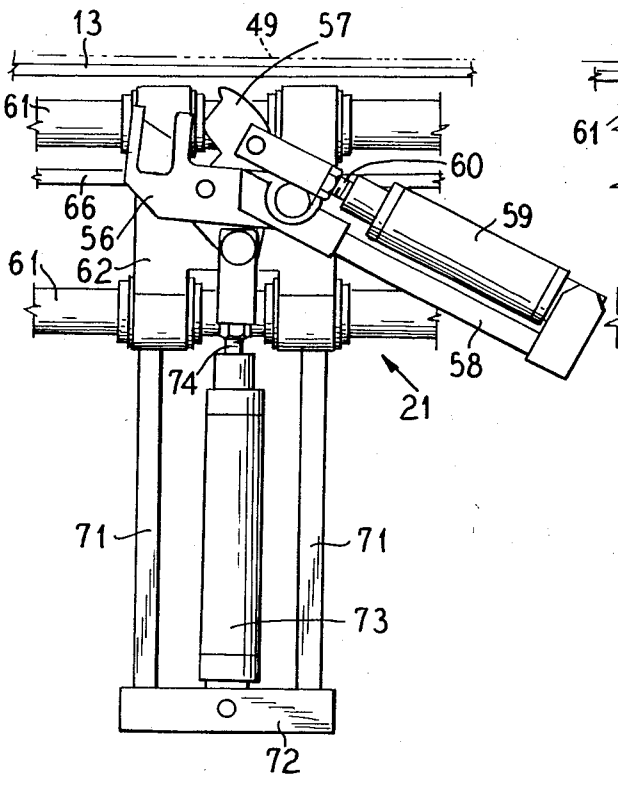
Figure 19F:
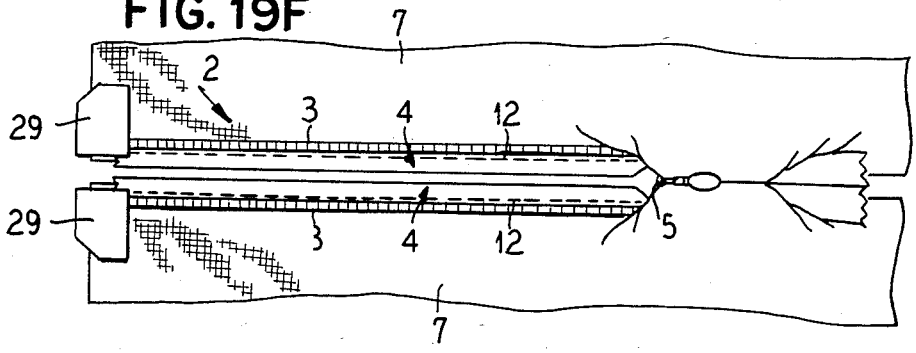
Figure 20G:
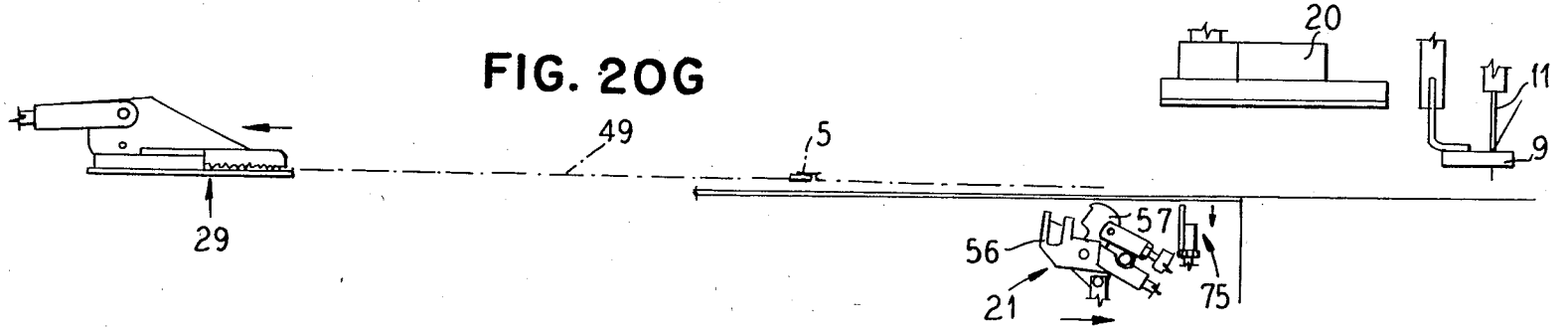

Thereafter, as shown in FIGS. 19F and 20G, the brake 75 is rendered inoperative to release the trailing end of the sewn product 49, while the gripper mechanism 18 is continued to discharge the sewn product 49. More specifically, in discharging the sewn product 49, when the contact member 48 on the slide 41 of the gripper mechanism 18 hits the actuator of the microswitch 47, a command signal is issued from the switch 47 to stop the servo motor which drives the endless belt 44. The discharging of the sewn product 49 of the gripper mechanism 18 is terminated. Then the connector 31 is pivotally moved on the slide 41 to direct downwardly, during which time the stacker 19 is pivotally moved, by the action of the air cylinder 52, forwardly of the base beneath the table 13, as shown in FIG. 13. The grippers 29 at the end portion of the connector 31 are opened to release the sewn product 49, which thus falls onto the transverse pipe 50 of the stacker 19. The stacker 19 and the gripper mechanism 18 are returned to their original or upstream positions. The slider-moving unit 21 is also returned to its original or upstream position near the station 14, during which time the slide-moving unit 21 remains retracted below the table 13. And the product guide 20 is returned to its raised position. Now the apparatus is in condition for start of the next cycle of the sewing operation, and a single cycle has been completed.

Figure 21:
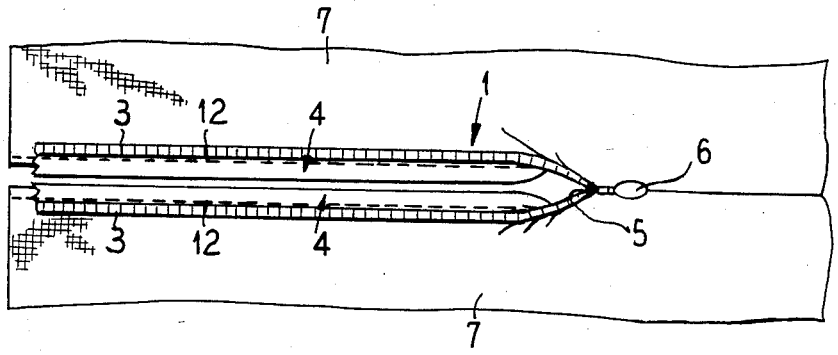
FIG. 21 is a fragmentary plan view of a concealed slide fastener sewn to the fabric pieces, with the opposed stringers uncoupled.
Figure 22:
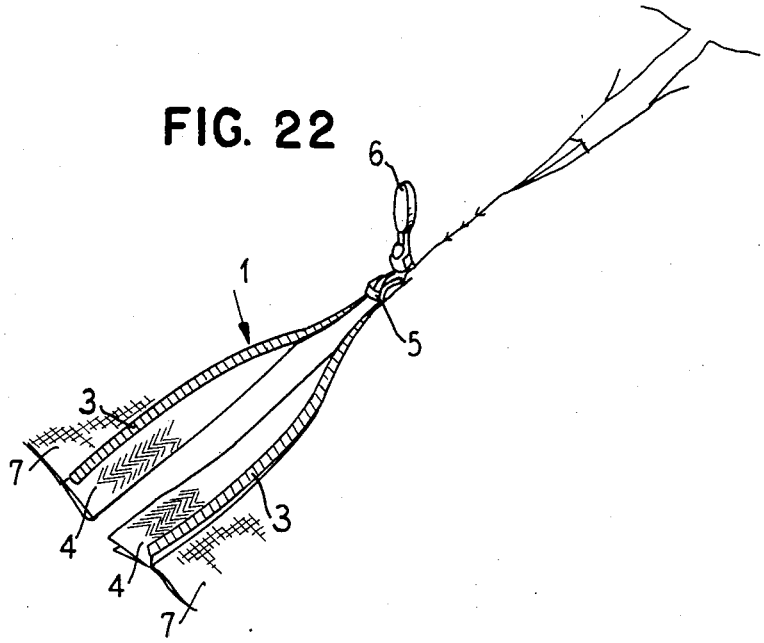
FIG. 22 is a perspective view of FIG. 21.
Figure 23:
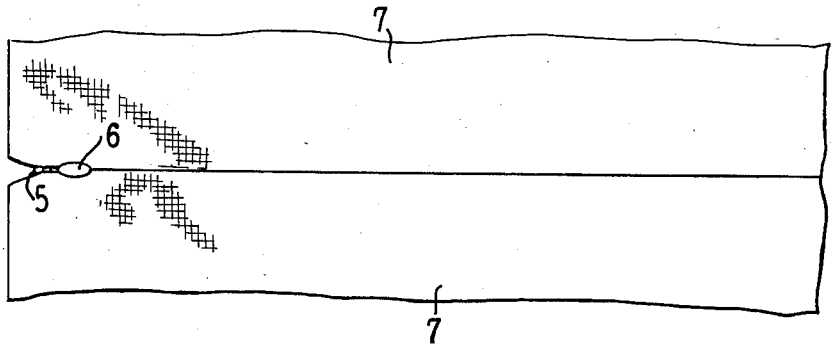
FIG. 23 is a fragmentary plan view of the concealed slide fastener of FIG. 21, showing the slide fastener fully closed.

FIGS. 21 and 22 show the sewn product including the concealed slide fastener 1 sewn to the pair of fabric pieces 7,7 according to the present invention. In this sewn product, the opposed coupling element rows 3,3 can be coupled smoothly and quickly by manually moving the slider 5 toward the top end stops (not shown), as shown in FIG. 23, during which time the opposed stringers 4,4 are progressively turned back in mirror symmetry.

In the sewn product obtained by the present method, since the slider is disposed into the region where each concealed fastener stringer and the corresponding fabric piece are sewn, smooth and quick coupling of the opposed stringers can be achieved simply by manually pulling the slider. Accordingly, the present method is particularly useful for the case in which a plurality of concealed slide fasteners are sewn to successive pairs of the fabric pieces and in which the sewn products are temporarily stacked and then supplied one after another to a finishing station where the opposed fastener stringers of each concealed slide fastener are coupled by manually moving the slider.

With the apparatus constructed according to the present invention, partly because the slider-moving unit is retractable below the upper surface of the table so as not to interfere with the gripper mechanism, it is possible to sew a plurality of concealed slide fasteners successively to successive pairs of fabric pieces without impeding the sewing and discharging operations, causing an improved rate of production.

Figure 24A:
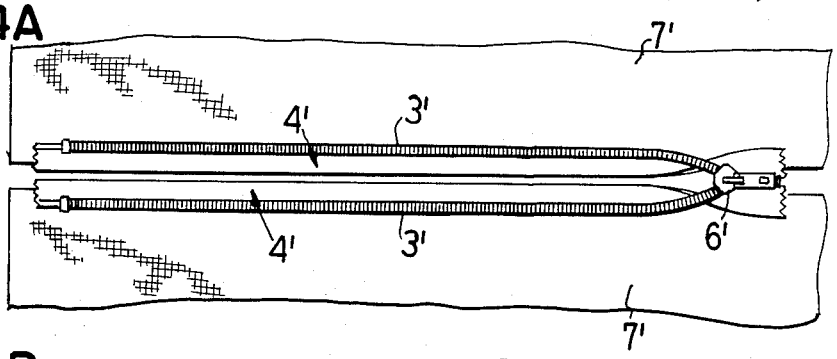
FIGS. 24A–24D are plan views of a non-concealed, or exposed, slide fastener illustrating successive steps of the present sewing method.
Figure 24B:
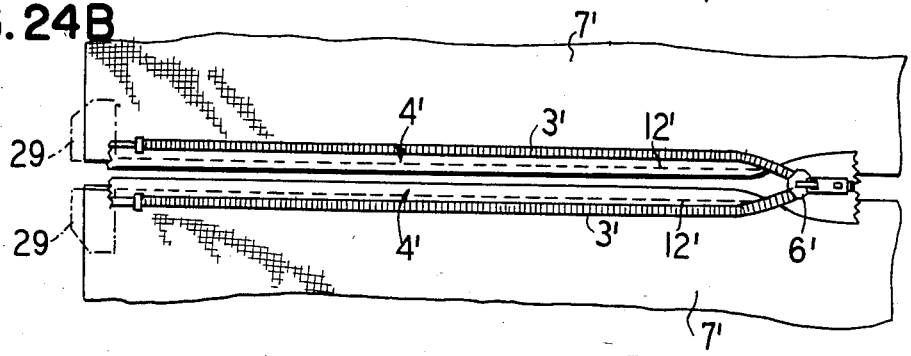
Figure 24C:
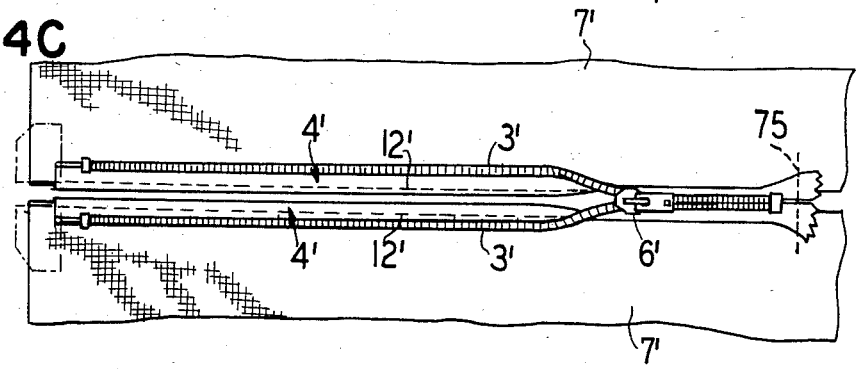
Figure 24D:
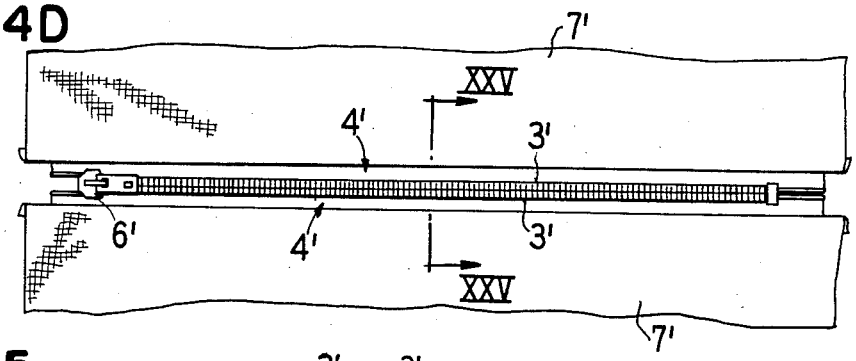
Figure 25:
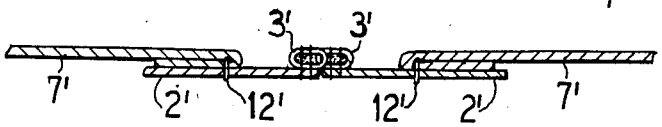
FIG. 25 is a cross-sectional view taken along the line XXV—XXV of FIG. 24.

The apparatus of the invention is especially useful in the sewing of concealed slide fasteners, as described above. However, it is clear that exposed slide fasteners may as well be sewn with the apparatus of the invention. Such assembly is illustrated in FIGS. 24A–24E. As there shown, tapes 2',2' of stringers 4',4' are aligned for sewing along stich lines 12',12' located further from the coupling element rows 3',3', then in the concealed slide fasteners embodiment of FIGS. 19A–F. An exposed type fastener is employed, so that coupling element rows 3' face downwardly, toward the fabric 7', 7' in the initial setup shown in FIG. 24A. As a result, when the sewing is completed the fabric 7',7' does not meet, leaving the coupling element rows and tapes exposed as shown in FIGS. 24D and 24E. The apparatus and method are in other respects the same, providing a substantially improved, more rapid system for fastener sewing and assembly.

Although various modifications may be suggested to those versed in the art, it should be understood that we wish to embody within the scope of the patent granted hereon, all such embodiments as reasonably and properly come within the scope of our contribution to the art; and intend to be limited only by the hereinafter appended claims.

We claim as our invention:

1. A method of sewing a concealed slide fastener to a pair of fabric pieces, the concealed slide fastener including a pair of fastener stringers, each stringer including a stringer tape having an inner longitudinal edge folded on itself supporting a row of coupling elements attached to the tape edge, there being a slider slidable on and along the fastener stringers for opening and closing the slide fastener, said method comprising the steps of:

(a) supplying the pair of fabric pieces to a sewing station defined by a sewing machine;

(b) uncoupling the pair of fastener stringers by moving the slider to a bottom end portion of the concealed slide fastener;

(c) introducing the uncoupled pair of fastener stringers, as superimposed over the respective fabric pieces, to the sewing station from a top end portion of the slide fastener, while turning the pair of fastener stringers upside down so that the stringers assume twisted positions in mirror symmetry with respect to the longitudinal centerline of the slide fastener;

(d) sewing the pair of fastener stringers to the respective fabric pieces from the top end portion of the slide fastener in the sewing station;

(e) drawing the concealed slide fastener by the top end thereof, with the pair of fabric pieces sewn thereto, forwardly from the sewing station, as said sewing progresses;

(f) terminating said sewing when the bottom end portion of the slide fastener approaches the sewing station;

(g) upon termination of said sewing, at least partially coupling the pair of fastener stringers to close the slide fastener by moving the slider from the bottom end portion of the slide fastener into the region where each fastener stringer is sewn to the respective fabric piece; and (h) finally, discharging the closed slide fastener, with the pair of fabric pieces sewn thereto.

2. An apparatus for sewing a concealed slide fastener to a pair of fabric pieces, the concealed slide fastener including a pair of fastener stringers, each stringer including a stringer tape having an inner longitudinal edge folded on itself supporting a row of coupling elements attached to the tape edge, there being a slider slidable on and along the pair of fastener stringers for opening and closing the slide fastener, said apparatus comprising:

(a) a table;

(b) a sewing station defined by a double-needle sewing machine mounted on said table for receiving the slide fastener stringers and the pair of fabric pieces in respective superimposed relationship;

(c) a first guide disposed upstream of said sewing station for guiding the pair of fabric pieces in laterally spaced relation to said sewing station;

(d) a second guide supported on said table and disposed above said first guide for supporting the concealed slide fastener with the pair of fastener stringers uncoupled, and for guiding the uncoupled pair of fastener stringers to said sewing station so as to turn the stringers upside down so that the stringers assume twisted positions in mirror symmetry with respect to the longitudinal centerline of the slide fastener;

(e) a gripper mechanism disposed downstream of said sewing station and reciprocable along a substantially horizontal first path, between an upstream position and a downstream position, for gripping and drawing the slide fastener, with the pair of fabric pieces sewn thereto, from said sewing station; and (f) a slider-moving unit disposed downstream of said sewing station and reciprocable, along a second path parallel to said first path, for moving the slider on the pair of fastener stringers from the bottom end portion of the slide fastener into the region where each fastener stringer is sewn to the respective fabric piece, said slider-moving unit being retractable from said second path so as not to obstruct the movement of said fabric pieces along said first path.

3. A method of sewing a slide fastener to a pair of fabric pieces, the slide fastener including a pair of fastener stringers, each stringer including a stringer tape having an inner longitudinal edge supporting a row of coupling elements attached to the tape edge, there being a slider slidable on and along the fastener stringers for opening and closing the slide fastener, said method comprising the steps of:

(a) supplying the pair of fabric pieces to a sewing station defined by a sewing machine;

(b) uncoupling the pair of fastener stringers by moving the slider to a bottom end portion of the slide fastener;

(c) introducing the uncoupled pair of fastener stringers, as superimposed over the respective fabric pieces, to the sewing station from a top end portion of the slide fastener, while turning the pair of fastener stringers upside down so that the stringers assume twisted positions in mirror symmetry with respect to the longitudinal centerline of the slide fastener;

(d) sewing the pair of fastener stringers to the respective fabric pieces from the top end portion of the slide fastener in the sewing station;

(e) drawing the slide fastener by the top end thereof, with the pair of fabric pieces sewn thereto, forwardly from the sewing station, as said sewing progresses;

(f) terminating said sewing when the bottom end portion of the slide fastener approaches the sewing station;

(g) upon termination of said sewing, at least partially coupling the pair of fastener stringers to close the slide fastener by moving the slider from the bottom end portion of the slide fastener into the region where each fastener stringer is sewn to the respective fabric piece; and (h) finally, discharging the closed slide fastener, with the pair of fabric pieces sewn thereto.

4. An apparatus for sewing a slide fastener to a pair of fabric pieces, the slide fastener including a pair of fastener stringers, each stringer including a stringer tape having an inner longitudinal edge supporting a row of coupling elements attached to the tape edge, there being a slider slidable on and along the pair of fastener stringers for opening and closing the slide fastener, said apparatus comprising:

(a) a table;

(b) a sewing station defined by a double-needle sewing machine mounted on said table for receiving the slide fastener stringers and the pair of fabric pieces in respective superimposed relationship;

(c) a first guide disposed upstream of said sewing station for guiding the pair of fabric pieces in laterally spaced relation to said sewing station;

(d) a second guide supported on said table and disposed above said first guide for supporting the concealed slide fastener with the pair of fastener stringers uncoupled, and for guiding the uncoupled pair of fastener strangers to said sewing station so as to turn the stringers upside down so that the stringers assume twisted positions in mirror symmetry with respect to the longitudinal centerline of the slide fastener;

(e) a gripper mechanism disposed downstream of said sewing station and reciprocable along a substantially horizontal first path, between an upstream position and a downstream position, for gripping and drawing the slide fastener, with the pair of fabric pieces sewn thereto, from said sewing station; and (f) a slider-moving unit disposed downstream of said sewing station and reciprocaple, along a second path parallel to said first path, for moving the slider on the pair of fastener stringers from the bottom end portion of the slide fastener into the region where each fastener stringer is sewn to the respective fabric piece, said slider-moving unit being retractable from said second path so as not to obstruct the movement of said fabric pieces along said first path.

5. The apparatus set forth in claim 2 or 4 including brake means "frictionally pressing said fastener adjacent its bottom end prior to movement of said slider by said slider-moving unit.

6. The apparatus set forth in claim 2 wherein said gripper mechanism comprises a pair of transversely spaced gripper means for gripping respective stringers and wherein said slider moving unit is selectively movable into and out of the plane defined by the distance between the spaced gripper means as they move longitudinally along said first path.

7. The apparatus set forth in claim 4 wherein said gripper mechanism comprises a pair of transversely spaced gripper means for gripping respective stringers and wherein said slider moving unit is selectively movable into and out of the plane defined by the distance between the spaced gripper means as they move longitudinally along said first path.

8. Apparatus set forth in claim 5 wherein said gripper mechanism comprises a pair of transversely spaced gripper means gripping respective stringers and wherein said slider moving unit is selectively movable into and out of the plane defined by the distance between the spaced gripper means as they move longitudinally along said first path.

9. The apparatus set forth in claim 2 wherein said slider moving unit is projected into said first path after said gripper mechanism has moved downstream of the most upstream position of said slider-moving unit.

10. The apparatus set forth in claim 4 wherein said slider moving unit is projected into said first path after said gripper mechanism has moved downstream of the most upstream position of said slider-moving unit.

11. The apparatus as set forth in claim 2 wherein said gripping mechanism pivots out of said horizontal first path adjacent the end of its downstream movement to extend the downstream movement of the fabric.

12. The apparatus as set forth in claim 4 wherein said gripping mechanism pivots out of said horizontal first path adjacent the end of its downstream movement to extend the downstream movement of the fabric.

* * * * *